US006565818B1

(12) United States Patent
Jarvinen

(10) Patent No.: US 6,565,818 B1
(45) Date of Patent: May 20, 2003

(54) RECYCLING SYSTEM

(76) Inventor: Mauri A. Jarvinen, 1707 N. Spring St., Pensacola, FL (US) 32501

( * ) Notice: Subject to any disclaimer, the term of this patent is extended or adjusted under 35 U.S.C. 154(b) by 0 days.

(21) Appl. No.: 09/280,165

(22) Filed: Mar. 29, 1999

(51) Int. Cl.[7] ..... D06F 39/02

(52) U.S. Cl. ..... 422/277; 422/278; 422/281; 68/17 R; 134/93

(58) Field of Search ..... 422/261, 264, 422/265, 266, 277, 278, 281; 68/17 R; 134/93

(56) References Cited

U.S. PATENT DOCUMENTS

| | | | | | |
|---|---|---|---|---|---|
| 83,329 | A | | 10/1868 | Sherwood | |
| 136,335 | A | | 2/1873 | Owen et al. | |
| 598,011 | A | | 1/1898 | Rylunder | |
| 2,032,524 | A | * | 3/1936 | Bobrick | 422/266 |
| 2,304,867 | A | * | 12/1942 | Wenker | 422/266 |
| 3,073,674 | A | * | 1/1963 | Rudelick | 422/266 |
| 3,333,282 | A | | 8/1967 | Muster | 4/187 |
| 3,496,741 | A | | 2/1970 | Arlt, Jr. | 68/232 |
| 4,227,546 | A | * | 10/1980 | Bergeson | 134/58 |
| 4,687,121 | A | | 8/1987 | Copeland | 222/64 |
| 4,700,554 | A | * | 10/1987 | Eichman et al. | 422/266 |
| 5,549,875 | A | * | 8/1996 | Laughlin et al. | 422/266 |
| 5,620,671 | A | * | 4/1997 | Shoemaker | 422/266 |

FOREIGN PATENT DOCUMENTS

| | | |
|---|---|---|
| EP | 0484607 | 11/1990 |

* cited by examiner

*Primary Examiner*—Elizabeth McKane
(74) *Attorney, Agent, or Firm*—Mauri A. Jarvinen; Sherrie D. Jarvinen

(57) ABSTRACT

A recycling system melts unused portions of soap in order to improve the efficiency of the soaking procedure. A chamber has a pump and a screen that holds the soap disposed therein, while a tube member connects to the chamber. One or two conduits are fluid flow connected to the outlet port of the pump and each have one or more jets that protrude through the tube member. Soap is placed onto the screen and water is drawn into the chamber by the pump. The inlet pattern of the pump creates a flow of water that flows over the soap on the screen, with the soap laden water being pumped through the conduits and discharged into the sink by the jets. Now that the soap has melted into soap laden water, pieces and bits of soap will not stick to the fabric at the conclusion of the soak wash period. A fluid level switch deactivates the pump if the water within the sink falls below a certain level.

9 Claims, 5 Drawing Sheets

RECYCLING SYSTEM

BACKGROUND OF THE INVENTION

1. Field of the Invention

The present Invention relates to a device that melts and recycles soap during a soaking procedure.

2. Background of the Prior Art

In a typical Hotel, most guests tend to stay only a few nights. Each guest room is provided with one or more bars of soap as the guest has time to use only a small portion of such bars, the remainder of the bars are discarded, resulting in a waste of most of the soap bar. This soap waste is especially acute in Hotels that change out the soap bars each day regardless of the minimality of the use of the bar.

A large portion of Hotels have on site laundry facilities for use by Hotel personnel. These laundry facilities are used to launder the bed sheets and towels of the guest rooms as well as the towels and tablecloths of the Hotel's eateries. Even the best washing machines found in a Hotel laundry do not achieve the level of cleanliness that managers like.

It would be advantageous to apply the cleaning power of the currently discarded bars of soap to complement the washing procedures found in a Hotel laundry.

Therefore, there is a need in the art for a device that will melt discarded soap bits during a soaking period in order to complement the regular laundry process and to improve the cleanliness of the product being washed. Such a device must be of relatively simple design, operation, and capable of melting soap into a soap laden solution and should be utilizable with washing facilities found within most Hotels, Restaurants, and the like, with a utility sink on the premises.

SUMMARY OF THE INVENTION

The recycling system of the present invention addresses the aforementioned needs in the art. The recycling system provides a device that melts bits of soap, such as discarded bits of soap bars, during a soaking procedure employing soapy water, thereby improving the cleanliness of the washed product. The device is simple in design and operation and can be used within a typical sink found within most target facilities.

The recycling system of the present invention is comprised of a chamber having a first opening, a second opening, and at least one intake opening. A lid can be removably attached to the chamber. A screen and pump having an outlet port are disposed within the chamber. A tube member has a first end secured to the first opening, a second end secured to the second opening, at least one side wall, and at least one third opening. A first conduit is disposed within the tube member and is fluid flow connected to the outlet port while at least one first jet is fluid flow connected to the first conduit and passes through the at least one side wall. A second conduit is disposed within the tube member and is also fluid flow connected to the outlet port by way of a Y-fitting that is also connected to the first conduit. At least one second jet is fluid flow connected to the first conduit and passed though the at least one side wall. Each of at least one first jet is disposed at a first radial angle relative to the tube member and each of the at least one second jet is disposed at a second radial angle (or angles) relative to the tube member that are different to the first radial angle of the first conduit. A fluid level switch is disposed within the tube member and is operatively connected to the pump for controlling the pump whenever fluid within the tube member drops below a certain level. Alternately, the chamber may have only one opening and the tube member extends in one direction therefrom with only one conduit extending within the tube member. As a further alternative, the chamber may have only one opening and the tube member that extends from this opening has a closed loop thereof, the ends of the closed loop meeting at the Y-fitting with the remaining end of the Y-fitting connected to the chamber. The two conduits are linked at a second Y-fitting with the remaining end of this Y-fitting fluid flow connected to the outlet port of the pump.

Soap is placed onto the screen within the device and the device is placed into a sink. The pump is activated and the pump pulls water through the intake openings of the chamber, pulls the water down over the soap on the screen and pumps it into the conduits and out through the jets, releasing the soap laden water into the sink and creating sufficient turbulence within the sink to clean the products therein. The pump also draws operating water through at least one third opening located on the tube member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
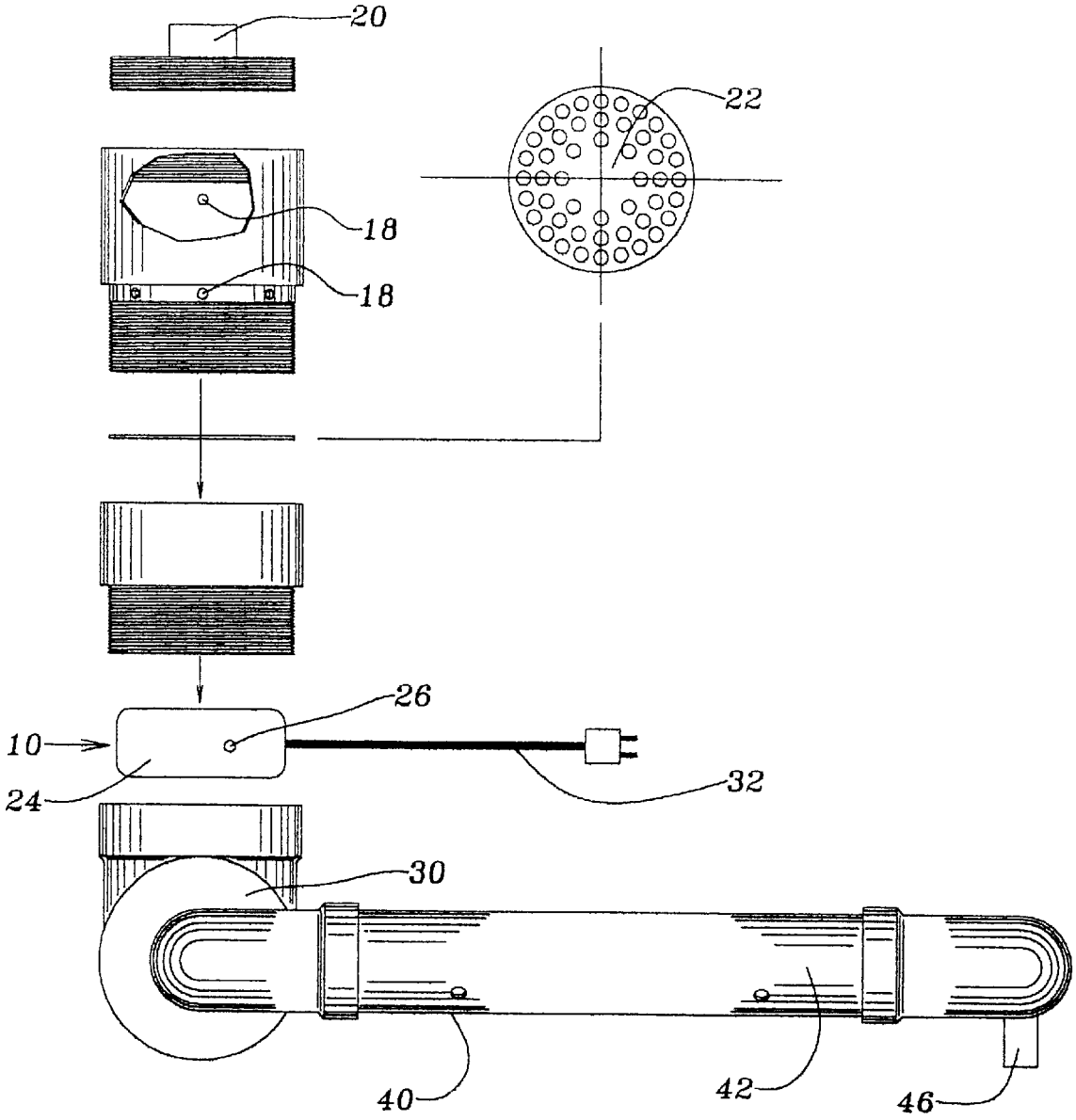
FIG. 1 is a partially exploded view of the recycling system of the present invention.
Figure 2:
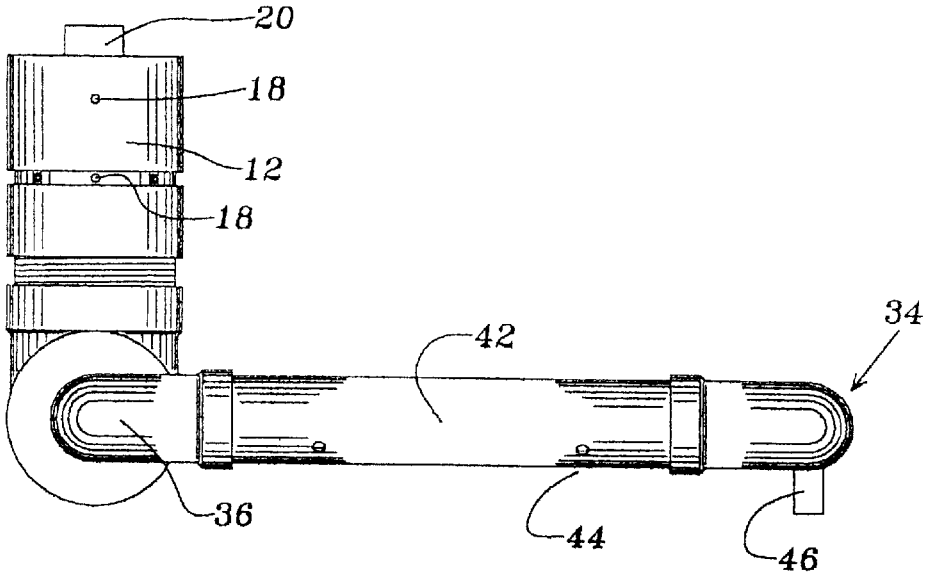
FIG. 2 is a side elevation view of the recycling system of the present invention.
Figure 3:
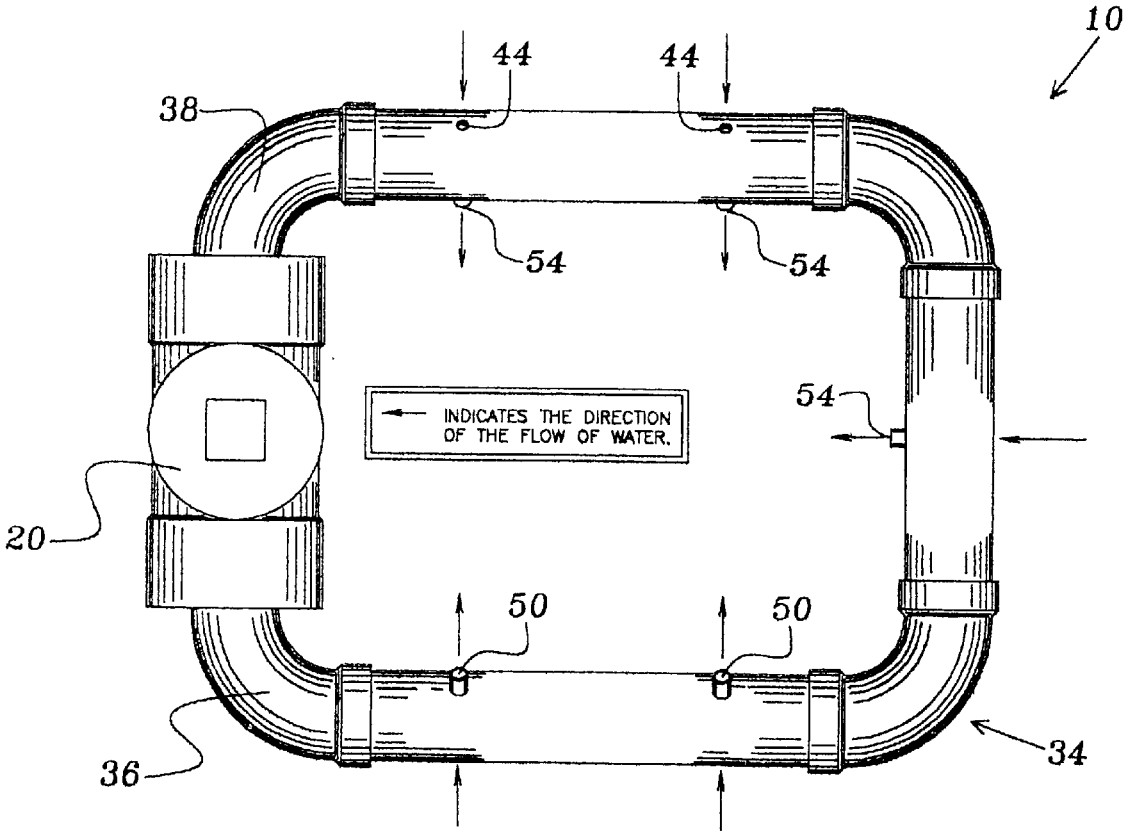
FIG. 3 is a top plan view of the recycling system.
Figure 4:
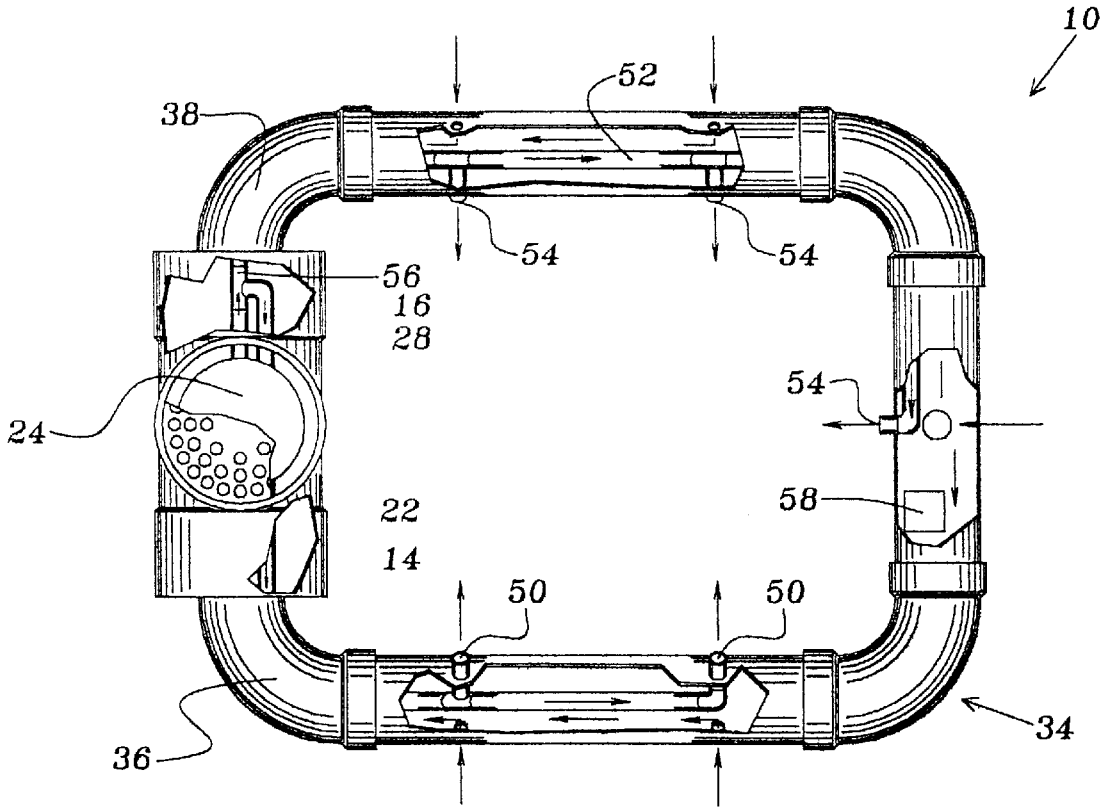
FIG. 4 is a partially sectioned top plan view of the recycling system.

Referring now to the drawings, it is seen that the recycling system of the present invention, generally denoted by reference numeral 10, is comprised of a chamber 12, having a first opening 14, a second opening 16 and at least one intake opening 18. A lid 20 may be removably attached to the chamber 12. As illustrated, the chamber 12 may be comprised of three sections although the chamber 12 may be a single station or any number of sections. A screen 22 is disposed within the chamber 12 in any appropriate fashion. A pump 24, having an intake port 26 and an outlet port, is disposed within the chamber 12 proximate the base 30 of the chamber. Power is supplied to the pump 24 by a standard electrical cord 32 which is appropriately sealed against moisture. A tube member 34 has a first end 36 that is connected to the first opening 14 of the chamber 12 and a second end 38 that is connected to the second opening 16 of the chamber 12. As seen, the tube member 34 has a base 40 and at least one side wall 42, and has at least one opening 44 located thereon. At least one leg 46 can also be located on the tube member 34. The tube member 34 may have any desired shape. A first conduit 48 is disposed within the tube member 34. At least one first jet 50 is fluid flow connected to the first conduit 48 and passes through the at least one side wall 42 of the tube member 34. A second conduit 52 is disposed within the tube member 34. At least one second jet is fluid flow connected to the second conduit 52 and passed through the at least one side wall 42 of the tube member 34. Each of the at least one filled jet forms a radial angle with respect to the base 40 of the tube member 34, this radial angle being different to the radial angle (or angles) formed by the at least one second jet 54 relative to the base 40 of the tube member 34. The first conduit 48 and the second conduit 52 are fluid flow connected to the outlet port 28 of the pump 24 by a Y-fitting 56 (throughout this disclosure the term Y-fitting and the term T-fitting are synonymous and interchangeable). A fluid level switch 58, of any appropriate design, is disposed within the tube member 34 and is operatively connected to the pump 24 such that if the fluid level detected by the fluid level switch 58 falls below a certain level, the fluid level switch 58 deactivates the pump 24.

Figure 5:
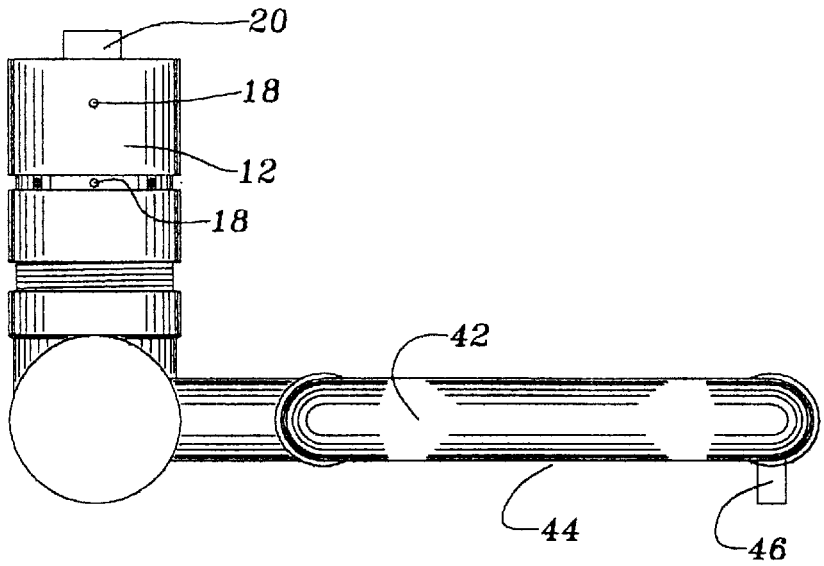
FIG. 5 is a side elevation view of an alternate embodiment of the recycling system of the present invention.
Figure 6:
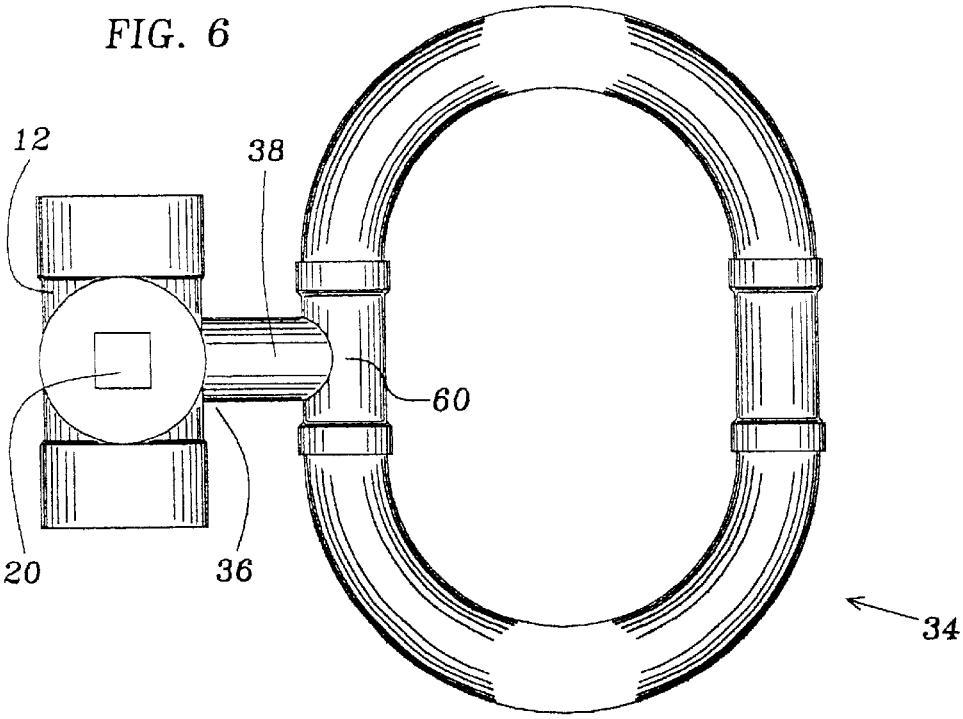
FIG. 6 is a top plan view of the alternate embodiment of the recycling system of the present invention.
Figure 7:
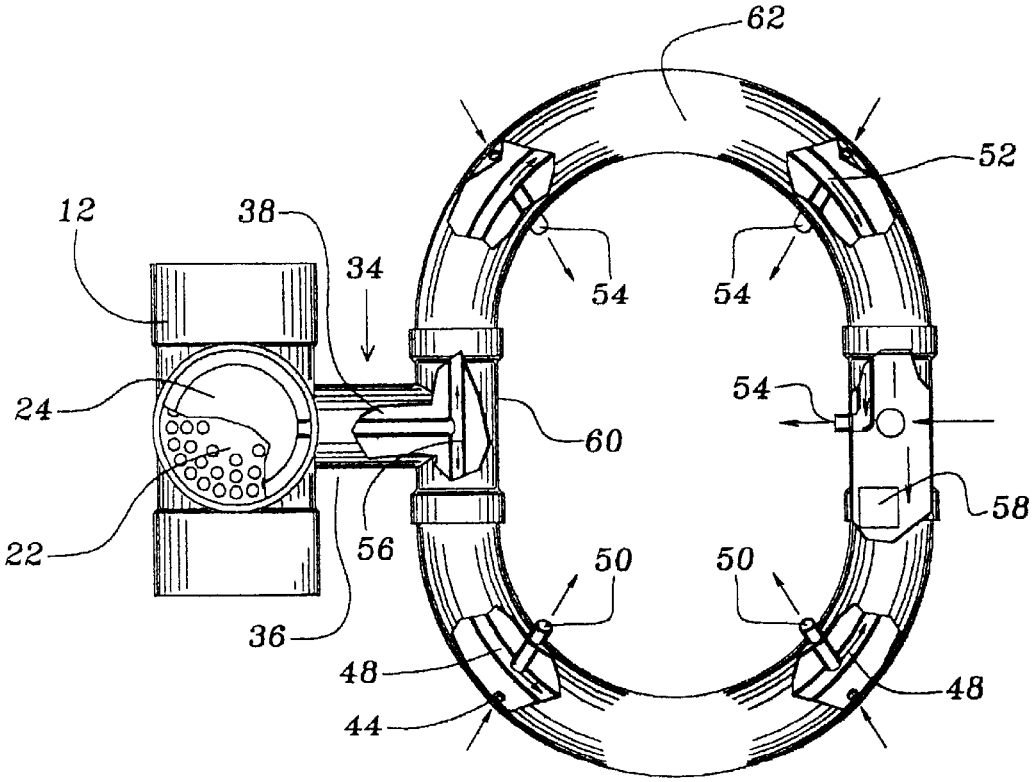
FIG. 7 is a partially sectioned top plan view of the alternate embodiment of the recycling system.
Figure 8:
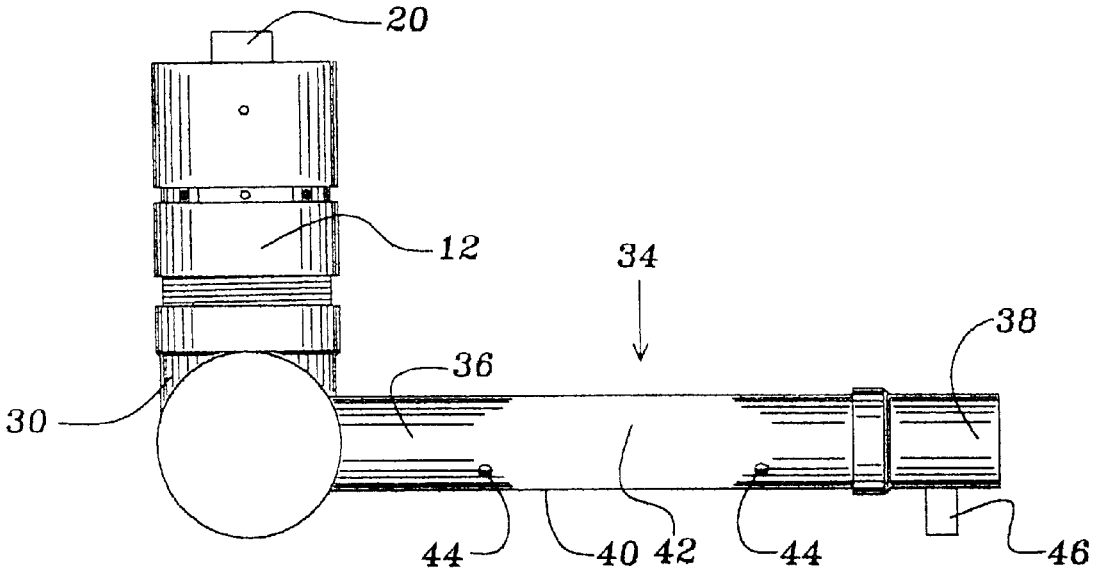
FIG. 8 is a side elevation view of a second alternate embodiment of the recycling system of the present invention.
Figure 9:
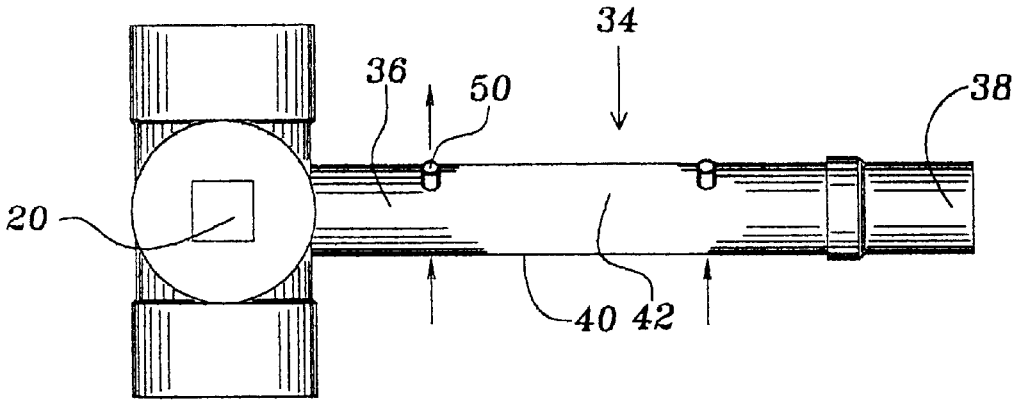
FIG. 9 is a top plan view of the second alternate embodiment of the recycling system.
Figure 10:
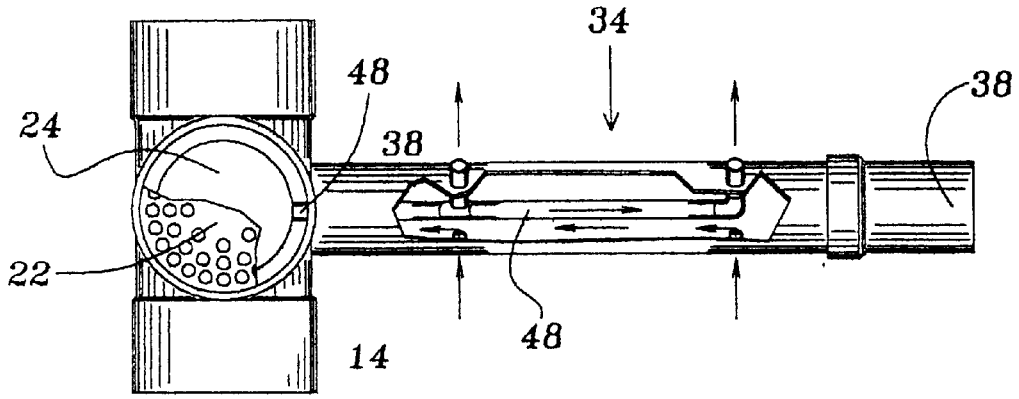
FIG. 10 is a partially sectioned top plan view of the seconds alternate embodiment of the recycling system.

Alternately, the chamber 12 may have only one opening 14 thereof and the tube member 34 is connected to this single opening 14. The tube member 34 may be one single leg, as illustrated in FIGS. 5–7 wherein the first end 36 is connected.to the chamber 34 and the second end 38 may be opened or closed, or the first end 36 is connected to the chamber 34 and the second end 38 of the single leg may be connected to a Y-fitting 60 and a closed loop 62 formed at the Y-fitting 60, as illustrated in FIGS. 8–10.

If the tube member 34 is just a single leg, only one conduit 48 is disposed therein. If the tube member 34 is a single leg connected to a Y-fitting the first conduit 34 and the second conduit 52 are each disposed within a portion of the tube member 34 and are joined by a second Y-fitting 56 that is fluid flow connected to the outlet port 28 of the pump 24.

In order to use the recycling system 10 of the present invention, the lid 20 is removed, soap is placed into the chamber 12 and onto the screen 22, and the lid 20 is replaced. The size of the mesh of the screen 22 determines the amount of soap passing therethrough, so that if different concentrations of soap are desired a screen 22 bearing different sized mesh is placed into the chamber 12. The device 10 is placed into a sink and the products to be washed are also placed into the sink. Once sufficient water has entered the sink, the pump 24 is activated. The pump 24 draws water into the chamber 12 via the intake openings 18 and passes the water through the soap on the screen 22. The soap laden water is then pumped through the conduit 48 of conduits 48 and 52 and through jets 50 and 54, thereby introducing soap laden water into the sink. By having radially offset jets 50 and 54, some of the jets discharge the soap laden water in an upwardly direction while some of the jets discharge the soap laden water in a downwardly directions while still other jets discharge the soap laden water in a straight forwardly direction, thereby assuring a good dispersion of the soap laden water throughout the sink. As the pump 24 sits near the base 30 of the chamber 12, the pump is in a sump and draws some of its operating water from the tube member 34 which draws the water in through its openings 44. Additionally, if the lower disposed intake openings 18 are clogged, the pump 24 may still draw water into the chamber 12 through the upper disposed intake openings 18.

If the water within the sink drops below a certain level, this condition is detected by the fluid level sensor 58 which automatically deactivates the pump 24.

Once the washing cycle is completed the device 10 is deactivated and operationally, removed from the sink.

While the invention has been particularly shown and described with reference to an embodiments thereof, it will be appreciated by those skilled in the art that various changes in the form and detail may be made without departing from the spirit and scope of the invention.

I claim:

1. A soap recycling system that liquefies soap pieces and creates a flow of soap laden water that removes soils from fabric when said system is placed into a sink having fluid therein, the system comprising:

a vertical chamber having a first opening located at a lower part of the chamber and a second opening for introducing soap pieces;

a pump, having an inlet and an outlet port, disposed within the vertical chamber;

a tube member having a side wall and first and second ends, wherein the first end of the tube is secured to the first opening of the chamber and wherein the side wall of the tube member includes at least one first opening therein and additionally an intake opening;

a first conduit disposed within the tube member and fluid flow connected to the outlet port of the pump; and at least one first jet fluid flow connected to the first conduit and passing through the at least one first opening in the side wall of the tube member;

wherein when the recycling system is placed into a sink having fluid therein and soap is placed into the vertical chamber, the pump is activated and draws the fluid through the tube member intake opening and discharges the fluid through the outlet port of the pump to the first conduit where it exits through the first jet into the sink.

2. The soap recycling system of claim 1 wherein the vertical chamber includes a third opening located at a lower part of the chamber and the second end of the tube member is connected to the third opening such that the chamber and the tubemember form a closed loop, the loop being horizontally disposed and the chamber being vertically disposed.

3. The soap recycling system of claim 1 further comprising:

at least one second opening extending through the side wall of the tube member;

a second conduit disposed within the tube member and fluid flow connected to the outlet port of the pump;

at least one second jet fluid flow connected to the second conduit and passing through the at least one second opening of the side wall of the tube member;

wherein the fluid discharged by the pump through the outlet port also passes through the second conduit and is discharged into the sink through the at least one second jet.

4. The recycling system as in claim 3 wherein each of the at least one first jet is disposed at a first radial angle relative to the tube member and each of the at least one second jet is disposed at a second radial angle relative to the tube member that is different to a first radial angle.

5. The soap recycling system of claim 3 further comprising a Y-fitting fluid flow connected to the first conduit, the second conduit, and the outlet port of the pump.

6. The recycling system as in claim 1 further comprising a screen disposed within the chamber.

7. The soap recycling system of claim 1 further comprising a lid removably secured to the second opening of the chamber.

8. The recycling system as in claim 1 further comprising a fluid level switch disposed within the tube member and operatively connected to the pump for controlling the pump.

9. The soap recycling system of claim 1 further comprising at least one intake opening located in the chamber such that the pump also draws fluid through the chamber intake opening.

* * * * *